US005192204A

United States Patent [19]

Musil

[11] Patent Number: 5,192,204

[45] Date of Patent: Mar. 9, 1993

[54] DUAL ATOMIZING MULTIFUEL BURNER

[75] Inventor: Joseph E. Musil, Ely, Iowa

[73] Assignee: Cedarapids, Inc., Cedar Rapids, Iowa

[21] Appl. No.: 854,210

[22] Filed: Mar. 20, 1992

[51] Int. Cl.[5] ..... F23M 3/04

[52] U.S. Cl. ..... 431/10; 431/183; 431/184; 431/284; 431/351; 239/404; 239/406

[58] Field of Search ..... 431/351, 284, 183, 184, 431/9, 10; 239/406, 404, 403, 402.5

[56] References Cited

U.S. PATENT DOCUMENTS

| | | | |
|---|---|---|---|
| 1,680,455 | 8/1928 | Fesler | 239/406 |
| 2,473,347 | 6/1949 | Sanborn . | |
| 3,612,737 | 10/1971 | Sharan | 239/404 |
| 4,095,929 | 6/1978 | McCartney | 239/404 |
| 4,298,337 | 11/1981 | Butler et al. . | |
| 4,333,405 | 6/1982 | Michelfelder et al. | 431/183 |
| 4,526,322 | 7/1985 | Voorheis . | |
| 4,559,009 | 12/1985 | Marino et al. . | |
| 4,600,377 | 7/1986 | Musil . | |
| 5,145,359 | 9/1992 | Ancona et al. . | |

FOREIGN PATENT DOCUMENTS

| | | | |
|---|---|---|---|
| 2123945 | 2/1984 | United Kingdom | 431/284 |

*Primary Examiner*—Carroll B. Dority
*Attorney, Agent, or Firm*—Simmons, Perrine, Albright & Ellwood

[57] ABSTRACT

A turbo burner assembly provides for dispersion of liquid fuel into a flame region adjacent a burner head of the assembly by using compressed air to force a fine spray through apertures in an atomizing assembly. The dispersed fuel is supplied at a variable rate that corresponds to the combustion settings of the burner over the entire operating range of the burner. The dispersed fuel becomes entrained into a low quantity flow of high velocity turbo air. The quantity or rate of flow of the high velocity turbo air corresponds to the combustion air required for the correct air to fuel mixture at the lowest fuel flow rate. At increasing fuel flow rates for increased combustion settings a second low velocity stream of turbo air is introduced at a variable volume flow rate to provide together with the first stream of turbo air a correct combustion mixture with the introduced fuel over the entire range of combustion settings of the burner assembly. A gaseous fuel can be substituted for the liquid fuel.

10 Claims, 3 Drawing Sheets

DUAL ATOMIZING MULTIFUEL BURNER

BACKGROUND OF THE INVENTION

1. Field of the Invention

This invention relates generally to industrial type burner units and more particularly methods of and apparatus for supplying and mixing fuel and combustion air within such burner units.

2. Discussion of the Prior Art

Industrial drying operations, for example, aggregate heating and drying operations of hot asphalt material production processes make use of high capacity burner units. State of the art burner units are capable of generating 250 million or more BTU (British Thermal Units) per hour. These high capacity burner units are typically operated with industrial grades of fuels, such as a burner grade diesel oil or special heating oils which may be heavier and more viscous than diesel oil. Dispersing fuel into combustion air and mixing the liquid fuel with combustion air to obtain quickly a most uniform mixture has been a problem over the years. Much development work has been applied to improve on fuel and air mixing devices and to thereby improve on the efficiencies of burner units. It is generally recognized that gaseous fuels are more readily mixed with combustion air than liquid fuels. Liquid fuels typically need to be first "atomized", meaning they are mixed with high pressure air and the high pressure air and liquid fuel mixture is released in a typically conical configuration as a spray of fine fuel droplets.

A problem occurs with fuel mixing provisions that even after liquid fuel has been "atomized" into fine droplets, the fuel is carried off by the air without being mixed. The conical shape of outwardly moving fuel droplets tend to make only surface contact with a stream of axially flowing volume of combustion air. For optimum combustion mixtures, it would be desirable to disperse the fuel uniformly throughout the combustion air. The dispersion process becomes more complex, when burner units are to be operated at non-constant energy output rates, as is desirable, when the burner units are used in aggregate drying and heating applications in the production of asphalt, for example. A further complication with respect to such aggregate drying and heating operations relates to the availability of fuel. Often the operators of the asphalt production equipment need to shift from one type of fuel supply to another. Fuel changes from coal dust to liquid fuel and to gaseous fuel need to be accommodated.

An optimization of one type fuel and air mixing system may have negative effect on another system for mixing air with another type fuel. The prior art shows various patents which seek to improve mixing of liquid fuel with combustion air.

U.S. Pat. No. 2,473,347 shows a central spray nozzle from which a conical shape of fine fuel droplets is emitted. An annular, axial air path is intersected by the conically outward proceeding spray of fuel. Thereafter the conically shaped fuel approaches a swirling volume of combustion air which volume is peripherally supplemented by secondary air which is also mixed through swirling vanes. The various volumes of air, except for that of the initial atomizing air are supplied at substantially the same pressure energy level and are combined in a swirling generally outward flow direction. Incomplete dispersion of the fuel into the various volumes of gas may result because the gases and the fuel progress at similar velocities and somewhat tangentially with respect to each other. Because of the speed at which combustion typically occurs after the fuel becomes mixed with primary air and is ignited, the mixture will be well toward the completion of the combustion process well before complete mixing can take place.

U.S. Pat. No. 4,526,322 seeks to improve the dispersion of fuel with initial combustion air by introducing fuel in a counterflow direction into a primary air stream. The impact of fuel and primary air is expected to enhance the mixing of the primary air with the fuel prior to the initiation of the actual combustion of the air.

U.S. Pat. No. 4,298,337 introduces liquid fuel which is atomized with high pressure air into a swirling primary air stream. An alternate gaseous fuel is distributed into the primary air by being routed together with the primary air through swirl plates.

U.S. Pat. No. 4,559,009 atomizes fuel oil by introducing the fuel oil in a continuous sheet into an inner stream of air and then collides the inner stream of air with an outer stream of air. The specification also discloses an annular pipe for introducing a gaseous fuel. The primary air intersects the annular axial flow pattern of the gaseous fuel to promote mixing.

SUMMARY OF THE INVENTION

According to the present invention, an industrial multi-fuel burner unit includes a central liquid fuel dispersion nozzle having conically outward directed liquid fuel spray jets. A primary mixer air outlet pipe of pressurized air is annularly disposed about the liquid fuel dispersion nozzle. The primary mixer air outlet pipe includes an annular array of deflector vanes disposed radially within the opening between the primary mixer air outlet and the liquid fuel dispersion nozzle for diverting an axial annular flow of air into a conically skewed air flow which intersects the conically outward direction of the path of the spray jets at a conically skewed angle. A gaseous fuel injection pipe is disposed coaxially about the primary mixer air outlet and forms with the primary mixer air outlet an annular axial flow gas inlet, a cylindrical gas injection pattern of which is intercepted by the conically skewed primary mixer air pattern from the primary mixer air outlet pipe.

According to another aspect of the invention, the burner unit comprises a turbo air compressor for supplying pressurized air flow at a first pressure above atmospheric pressure and at a first flow rate. An air duct is annularly disposed about the gaseous fuel injection pipe and forms an annular outlet with the gaseous fuel injection pipe. The air duct channels turbo air flow axially of the burner unit toward the annular outlet. The annular outlet of the air duct includes radially disposed deflector vanes for skewing air flow outward away from an axial flow direction. A variable flow restrictor valve is disposed at the inlet of the air duct for the turbo air. The variable flow restrictor valve is coupled to burner controls which selectively adjust the pressure of the turbo air downward from the first pressure to a second pressure above atmospheric pressure.

BRIEF DESCRIPTION OF THE DRAWINGS

The Detailed Description below may be best understood when read in reference to the accompanying drawings wherein.

DETAILED DESCRIPTION OF THE INVENTION

1. The Burner Environment

Figure 1:
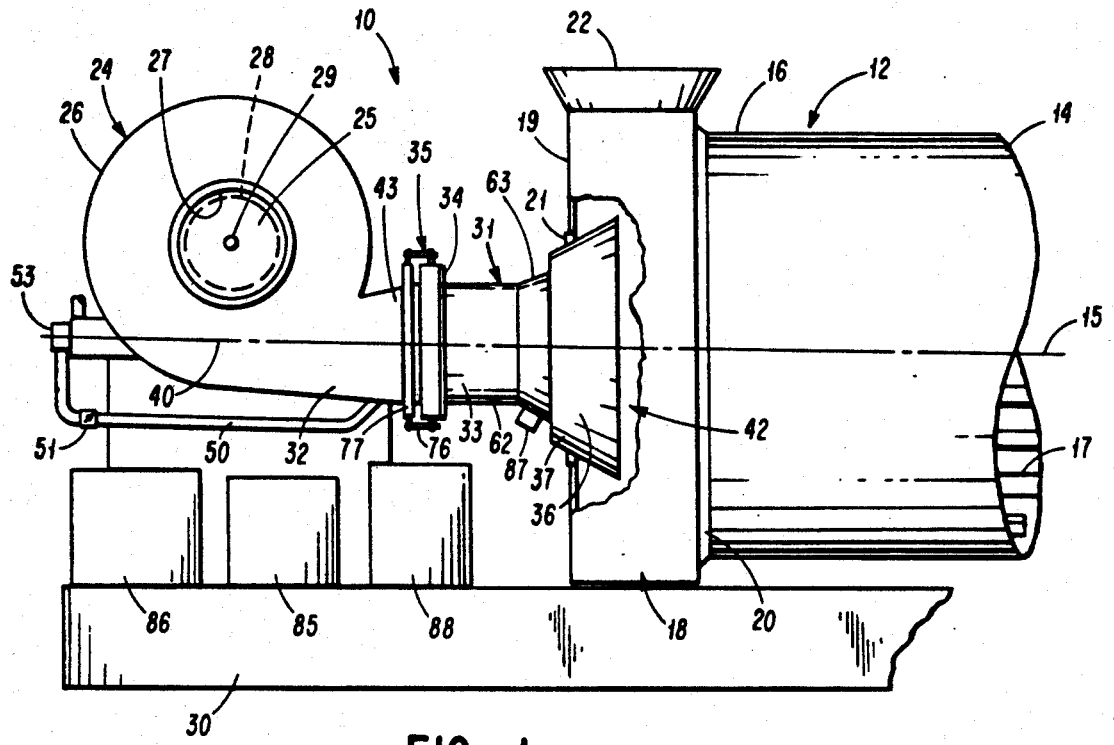
FIG. 1 is a partial side view of an aggregate drying apparatus including a turbo burner unit as a example of the invention in an environment to which the present invention advantageously applies, the schematic representation showing particular features of the present invention.

FIG. 1 shows somewhat simplified a general side view of a burner assembly 10 in combination with a drum drying apparatus 12, only an end of which is shown in relationship to the burner assembly 10. The drum drying apparatus 12 typically comprises an elongate cylindrical drum 14 which is disposed with its longitudinal axis 15 substantially horizontally and which is mounted and driven to rotate about its cylindrical axis 15. In a well known application, the drum drying apparatus 12 dries and heats aggregates for use in asphalt production. The burner assembly 10 operates to supply a hot gas flow which is applied to flow longitudinally through drying and heating regions of the drum 14. Material, such as virgin stone or crushed rock aggregate is moved by rotation of the drum 14 and by a slight inclination of the drum generally longitudinally through the drum 14. The longitudinal angle of the drum 14 with respect to the horizontal, either upward or downward from a burner end 16 of the drum, generally determines the flow movement of the aggregate materials through the drum 14. The drum 14 includes internal flights 17 which lift the aggregate materials and drop it through the hot gas stream within the drum 14 to cause the energy from the hot gases to heat and dry the materials.

In the production of asphalt, asphaltic materials would normally be added to the dried and heated aggregates. The amount of heat supplied by the burner assembly 10 must be capable of being regulated over a comparatively wide range of energy output. A turn-down ratio of 10 to 1 of the burner assembly 10 refers to the ability to reduce the energy output from a capacity of 250 million BTU, for example, to 25 million BTU. The greater the turn-down ratio of a burner unit between its maximum capacity and a minimum energy output without losing the flame, the greater is of course the usefulness of the burner unit.

The burner assembly 10 is shown, as an example, at an intake end 18 of the drum drying apparatus 12. The intake end or feed end 18 features a stationary feed box 19 which substantially closed the feed end of the drum drying apparatus 12. A peripheral seal 20 between the rotatably mounted drum 14 and the stationary feed box 19 and a second annular closure 21 between the burner assembly 10 and the feed box 19 provide a substantial closure of the feed end 18. Materials typically enter the feed box 19 through a hopper or chute 22 at the top of the feed box 19.

As will be understood from the further detailed description, the above described environment of a drum drying apparatus 12, such as for asphalt production, is but one example for use of the burner assembly 10 as further disclosed herein. Though of particular advantage when used on asphalt production equipment, such as the referred to drum drying apparatus, the advantages of the burner assembly 10 as will become apparent from the further detailed description thereof are also present in all other known uses in which a burner assembly in accordance herewith is needed.

2. The Burner Assembly in General

A desirably high energy output by the burner assembly 10, typically in excess of 100 million BTU per hour at less than full capacity of the burner assembly 10, is achieved by forced and even pressurized air flow through the burner assembly 10. The burner assembly includes therefore a motor driven centrifugal turbo compressor 24. The turbo blower causes the blower assembly 10 to be known as a turbo burner assembly or unit 10. The turbo compressor 24 has a central air inlet 25 disposed in a turbo housing 26 of substantially circular appearance. The turbo housing 26 houses a turbo blower 27 which is driven by a prime rotary mover, such as an industrial type electric motor 28, shown axially behind the turbo blower 27. The motor 28 may conveniently be coupled by its drive shaft 29 directly to the blower 27. The entire turbo burner assembly 10 may be mounted to and supported by an extension of an elongate frame structure 30 that also supports the drum drying apparatus 12.

Centrifugally pressurized "turbo air" has an advantage that it may be supplied to a burner head 31 in adequate volume and yet at a substantial pressure above atmospheric pressure of, for example, 25 to 30 ounces per square inch. Thus, even though the air flow at an outlet 32 of the turbo housing 26 is substantially opened to pass with little restriction to the burner head 31, the outlet pressure can still be maintained at a pressure of approximately twenty-five ounces. An inlet portion 33 to what is referred herein as the burner head 31 features a peripheral or annular inlet flange 34 which supports an air damper assembly or air valve 35. A front portion or outflow end 36 of the burner head 31 is the portion in which fuel and combustion air actually mixes. The outflow end 36 of the burner head 31 terminates in an outermost conical flame holder or flame holder cone 37.

Variations in energy output of the turbo burner assembly 10 are accomplished by changing flow rate of the fuel to the burner head 31 and by correspondingly changing the amount of combustion air that is moved through the burner head, primarily by the power supplied by the turbo compressor 24. The fuel is mixed with what is referred to as primary air and is ignited by one of a number of known burner ignition assemblies, such as electric ignition or pilot flame assemblies (not shown), for example. Secondary air is supplied to a limited degree to permit complete combustion of the fuel after the combustible mixture of primary air and fuel is initially ignited. However, it has been found desirable that the total amount of primary and secondary air does not exceed by a significant amount a critical combustion ratio of air to fuel, such that the total air supply is not much greater than the stoichiometric air. It has been found that improper mixtures of air and fuel produce in a high flame temperature unwanted pollution in the form of nitrous oxides. Improper fuel and air mixtures may in the absence of high flame temperatures result in combustion products which contain hydrocarbon gases, indicating incomplete combustion even when sufficient air for complete combustion had been supplied. Complete mixing of liquid fuels is important at both low and high fuel flow rates. It has been found that when comparatively clean burning combustion products are obtained at both low and high burner settings, combustion products at intermediate burner settings are also improved.

3. The Burner Head

Figure 2:
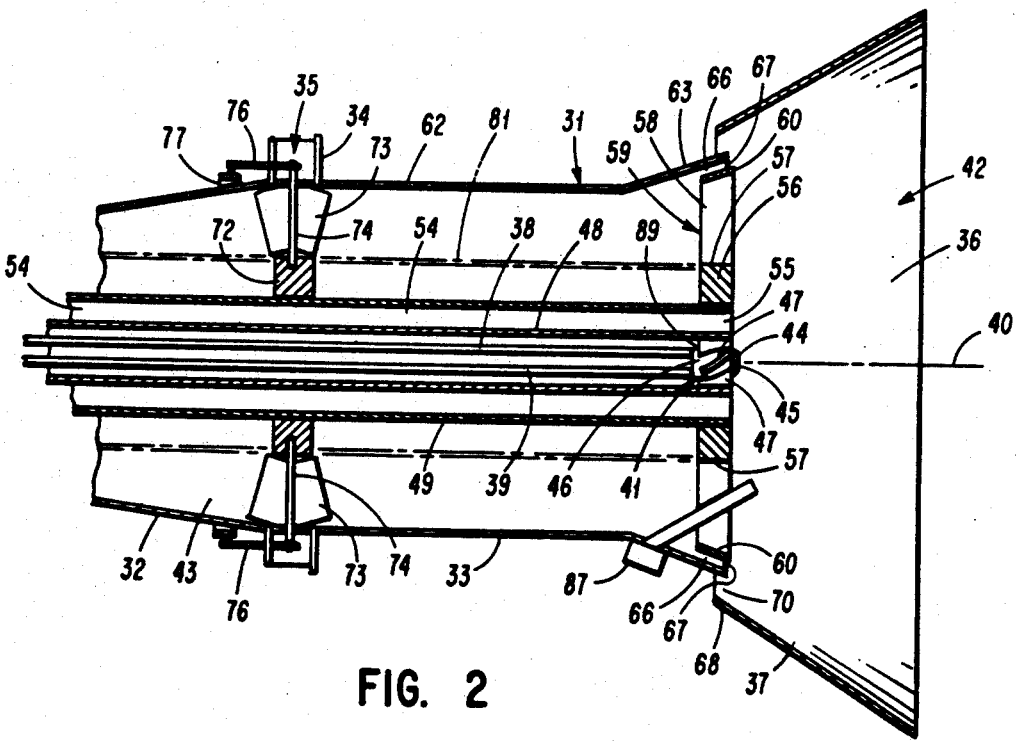
FIG. 2 is an enlarged view, partially in section, of the burner assembly shown in FIG. 1, showing a burner head and fuel infeed provisions to the burner head in greater detail.

FIG. 2 shows a partial view of the turbo burner assembly 10, and shows in particular a sectional view of the burner head 31. According to the preferred embodiment of the burner assembly 10, as described as an example of the invention, the inlet portion 33 adjacent the inlet flange 34 is substantially of cylindrical shape. The section through the burner head 31 shows concentric tubes with a centermost side-by-side compressed air and liquid fuel supply pipes or tubular lines 38 and 39, respectively. Though the simplified sectional view shows a single compressed air supply line 38 and a single liquid fuel supply line 39, it is to be noted that two compressed air supply lines 38 and two liquid fuel supply lines 39 can be arranged for increase structural strength at quadrangular corners disposed symmetrically about a central axis 40 through the burner head 31.

The liquid fuel supply line or lines 39 and the compressed air supply line or lines 38 extend forward through the inlet portion 33 toward the outflow end 36 where they are coupled to and lead into a nozzle assembly or "atomizer" assembly 41. The term "atomizing" fuel is commonly used in the art and is understood to mean that liquid fuel is broken up into fine droplets upon being released from the fuel supply system to be mixed with combustion air. The atomizer assembly 41 is substantially cylindrical in shape with a chamfered front and is disposed centered on the axis 40 of the burner head 31. The atomizer assembly 41 is the exit port for the fuel through which the fuel passes when it is released toward a flame region 42 extending forward of the flame holder cone 37 and away from the burner assembly 10. The atomizer assembly 41 has the function to release or disperse liquid fuel into the flame region 42 in form of a spray or mist of fine droplets of fuel.

The atomizer assembly 41 may be any of a number of known atomizer assemblies which are used to cause initial dispersion of liquid fuel into fine droplets. It is to be noted that the term "liquid fuel" includes typical industrial burner oils, but also liquid propane which is supplied under pressure in liquid form and is advantageously dispersed into droplets to promote rapid volatization. It further is to be understood that the compressed air supplied to the atomizer assembly through the supply line 38 is high pressure air generated by typical industrial air compressors or the like. Typically the pressure of the "atomizing" compressed air would consequently lie in a range of fifty to in excess of one hundred pounds per square inch. Thus the term "compressed air" is used for the air which causes the initial dispersion of liquid fuel into fine droplets. In contrast the term "pressurized air" will be used for the high pressure turbo air that typically exists at outlet duct 43 of the turbo compressor 24.

In a preferred arrangement the fuel is distributed to a peripheral arrangement of several equally spaced nozzles 44 which exit from the assembly 41 from the chamfered forward end 45 of the atomizer assembly 41 at a conically forward directed included angle of preferably seventy degrees. However, it should be noted that the included angle may be varied, as the number of the nozzles 44 may also be varied. As a general consideration, the included angle may be varied by about twenty degrees in either direction from the preferred seventy degrees. The cylindrical, external surface 46 of the atomizer assembly 41 supports a plurality of circumferentially spaced swirl or spinner vanes 47. The spinner vanes 47 extend substantially radially outward from the outer surface 46 toward and against an inner surface of an innermost concentric tube 48. The innermost concentric tube 48 finds its complement in a second outer concentric tube 49. The free cross-sectional space of the inner concentric tube 48 is its area less the space occupied by the supply lines 38 and 39 or the cross-sectional area of the atomizer assembly 41. The free cross-sectional space of the inner concentric tube 48 conducts high pressure turbo air from the outlet duct 43 of the turbo compressor 24 to the spinner vanes 47. The air exits through the spinner vanes 47 into the flame region 42 of the burner, losing its pressure but gaining speed instead. The high velocity of the exiting high pressure turbo air advantageously further disperses, mixes fuel and "atomizes" liquid fuel as it entrains it into its stream.

Figure 3:
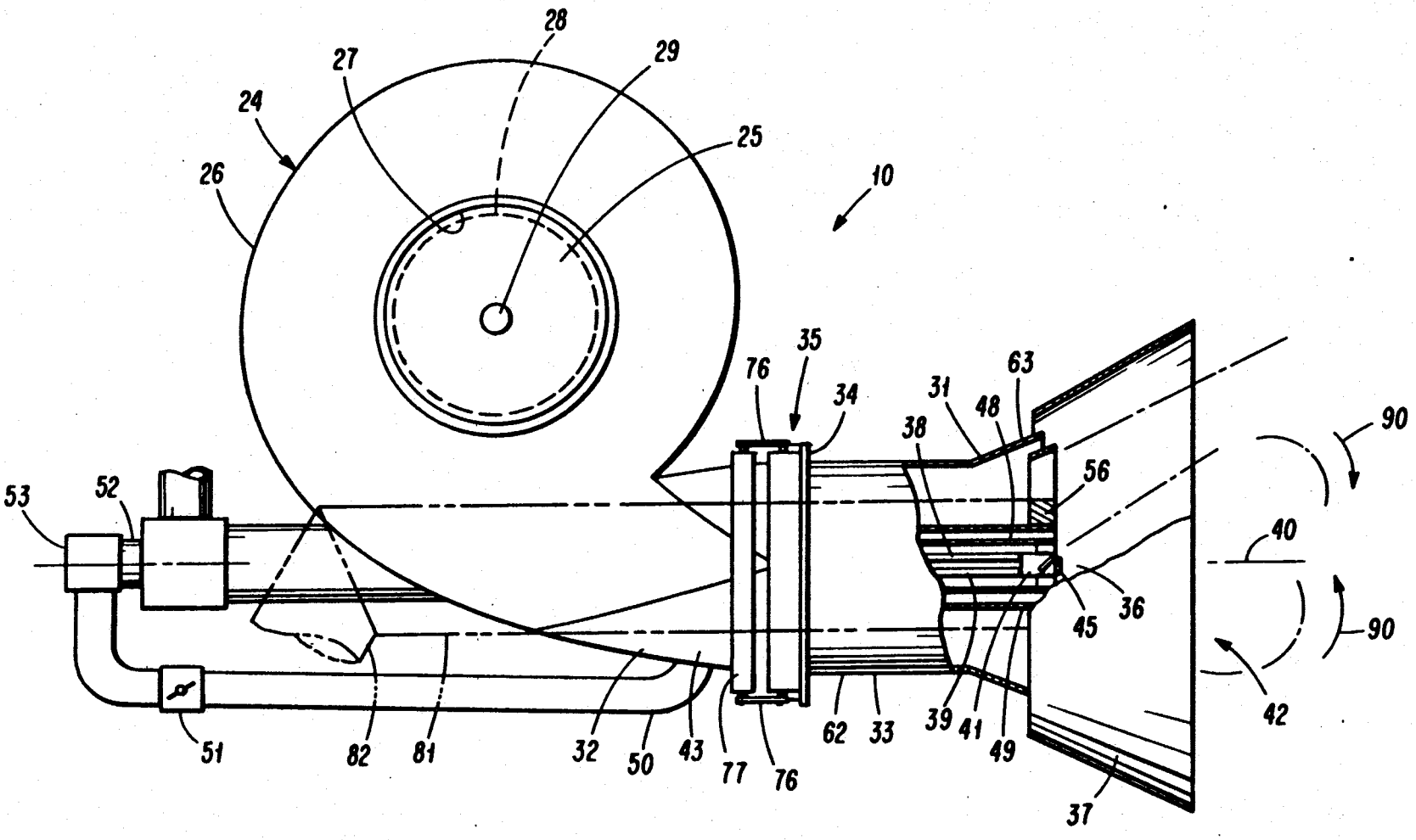
FIG. 3 is a simplified sectional view through a burner head of the burner assembly of FIG. 1 showing features of a particular embodiment of the invention.

A preferred routing of the high pressure turbo air into the inner concentric tube 48 is best illustrated in reference to FIG. 3. A high pressure turbo air duct 50 taps into the turbo compressor outlet duct 43. The air duct 50 includes a throttle valve 51 that may be used for throttling the high pressure air as referred to below with respect to gaseous fuels. The high pressure turbo air duct or tap air duct 50 is preferably routed to a tail end 52 of the inner concentric tube 48 and communicates through a coupling 53 with the outlet duct 43 to feed high pressure turbo air into the tube 48. The coupling 53 longitudinally also admits extensions of the supply lines 38 and 39.

Also in reference to both FIGS. 2 and 3, an annular space 54 between the inner and outer concentric tubes 48 and 49, respectively, is intended to feed gaseous fuels in lieu of liquid fuels to the burner head 31. Gaseous fuel need, of course, not be dispersed into fine droplets. Hence the use of natural gas, when available provides for a comparatively simple mixing process with combustion air with respect to that of liquid fuels. The annular space 54 extends forward to the burner head and terminates in an annular opening 55 concentrically disposed about the spinner vanes 47. The throttle valve 51 may be used to adjust the pressure of the high pressure turbo air, thereby reducing the velocity at which the high pressure turbo air exits from the opening 55. A pressure reducing valve adjustment may be desirable because of the lower mass of the gaseous fuel with respect to the liquid fuel.

A particular advantage of the high pressure turbo air is worth mentioning. The advantageous result comes into play when the burner assembly 10 is switched to fire with gaseous fuel instead of liquid fuel. Typically when liquid fuel is no longer atomized by the atomizer assembly 41, the flame of the burning gases in the flame region 42 adjacent the atomizer assembly may heat and damage the assembly 41. However, because of the high pressure turbo air continuously passing over the surface 46 of the atomizer assembly, the assembly 41 is cooled and protected by the exiting air.

Further in reference to both FIGS. 2 and 3, externally of the annular opening 55 for a gaseous fuel supply and substantially coplanar therewith, there is an annular closure ring or plug 56. The plug 56 has an annular width with an outer perimeter at a radial distance identified by the numeral 57. From the outer base 57 of what constitutes a circular configuration about the axis 40 there extend, radially and circumferentially equally spaced, a complement of outer or main spinnei vanes 58 of a main spinner assembly 59. The spinner vanes 58 are fixed in their relative positions within the spinner assembly 59 by a conically shaped circumferential vane assembly band 60.

The inlet portion 33 of the burner head is near cylindrical adjacent the inlet flange 34 but then begins to flare into a conical transition. Thus, the inlet portion 33 adjacent the peripheral inlet flange 34 is comprised of a cylindrical shell portion 62. A conical or flared outer shell portion 63 joins the cylindrical shell portion 62 and flares outward at a preferred flare angle of fifteen degrees with respect to the longitudinal axis 40. The precise flare angle of the outer shell portion 63, of course, is a matter of choice. The purpose is intended to provide for a desirably efficient transition of combustion gases into the flame holder cone 37. A narrow peripheral gap 66 between the peripheral vane assembly band 60 and an outer end 67 of the outer shell portion 63 is intended to provide for a non-skewed or substantially axial flow of combustion air in a peripheral region adjacent the conical burner head surfaces 63 and 37.

The frustro-conical shape of the flame holder cone 37 has a small diameter at its inner end 68 and is positioned to provide for a peripheral secondary air gap 70 between the inner end 68 of the flame holder cone 37 and the outer end 67 of the conical shell portion 63. Turbo air escaping through the gap 66 causes secondary air to be drawn in through the gap 70. The main air flow of turbo air exiting from the inlet portion 33 of the burner head 31 into the flame region 42 passes through the main spinner vane assembly 59 and is deflected by its vanes at an outward skew angle in a conically outward flow pattern. Because of the heat generated within the flame region 42 structural elements of the burner head 31 and particularly the elements directly exposed to the flame are desirably manufactured of heat resistant materials which do not readily oxidize, such as stainless steel, for example.

The air damper assembly or air valve 35 between the outlet duct 43 of the turbo compressor 24 and the burner head 31 controls the amount of air admitted to the burner and is adjusted in conjunction with fuel flow adjustments as part of the regulation of the burn rate or energy output of the turbo burner assembly 10. The air valve 35 may be comprised of a stationary and an angularly movable, or rotatable about its center axis 40, damper disk having alternately open and closed sectors. When the closed sectors and the open sectors coincide the air valve 35 is open. When the closed sectors of the movable disk overlap or coincide with the open sectors of the stationary disks the air valve 35 is totally closed. In this described known embodiment the wide open position has an open area of less than one half of the area of the damper disks. FIG. 2 shows an embodiment which may be preferred for controlling the turbo air flow to the burner head 31 as will become apparent from the following description.

The air valve 35 includes an inner annular closure ring or plug 72. The closure ring 72 reduces the available cross-sectional area. A plurality of frustro-sectorial baffle plates 73 are rotatably supported by radially disposed shafts 74. Rotation of each of the shafts 74 and their respective baffle plates 73 occurs in unison. A crank arm 76 attached to an outer end of each of the shafts 74 is ganged to a rotator ring 77 to provide by its rotation about the axis 40 the same angular excursion for each of the baffle plates. The open area ratio for closed and open positions of the baffle plates 73 is greater than for open and closed sectors of a disk, such that the open to closed ratio of the described baffle type air valve approximates that of the dual sectorial disk embodiment.

The purpose of the closure rings 56 and 72 is to permit a conversion of the described turbo burner assembly to permit yet a third type of fuel, namely finely powdered coal. Coal in the form of dust is typically suspended in air and is blown into flame regions of burners, such as the turbo burner assembly 10. A coal fuel conversion of the turbo burner assembly 10 would require the removal of the plugs 56 and 72 and an insertion of a third concentric tube 81 together with a header coupling 82 (both shown in phantom lines) to admit the previously described elements into the interior space of the tube 81. Typically, coal as a fuel is least available. Coal when suspended in air is abrasive and destructive of its conduits. Certain coals contain pollutants that are undesirable. However, the preferred structure of the turbo burner assembly as described herein provides for coal conversions for applications or occasions in which coal as a fuel becomes desirable or even necessary.

It is to be noted that the coal conversion is provided in a manner that will allow the passage of turbo air into and through the burner head 31 to proceed without change. The rotatable baffle plates 73 may function in substantially the same manner as for gaseous or liquid fuels. Thus, even though changes in the apparatus need to be made to provide coal to be burned, major described elements of the turbo burner assembly 10 including their physical and functional relationships may remain to minimize the cost of a coal conversion.

4. The Burner Operation

Advantages of the described structural elements are found in the operation of the turbo burner assembly 10 as described particularly for liquid and gaseous fuels. The burner operation can be switched between liquid fuels and gaseous fuels without modifications other than connecting supplies of the respective fuels.

In reference to FIG. 1, the operation of the burner assembly 10 with liquid fuels desirably requires a typical source of compressed air, as shown schematically at 85. The source 85 may be a typical air compressor. The compressed air source 85 is communicatively coupled to the compressed air supply line 38. The burner may be started by providing liquid fuel from a liquid fuel supply 86. The liquid fuel supply would be communicatively coupled through fuel supply line 39 to the atomizer assembly 41 to be mixed with compressed air in and expelled from the atomizer assembly in a conical configuration of a fine fuel spray. The spray at a low flow rate may be ignited by one of various known pilot or ignitor assemblies, such as an ignitor tube indicated schematically at 87. Burner controls 88 selectively adjust fuel flow and the settings of the baffle plates of the air valve 35 over a full range of combustion settings of the burner assembly 10. At an extreme low of the range the valve 35 is closed. The entire combustion air will then be supplied by the high pressure turbo air exiting through the space between the spinner vanes 47. The turbo compressor 41 would consequently have been turned on prior to that time that the fuel is supplied to atomizer assembly 41 to supply necessary combustion air. The air valve 35 will be substantially closed and the fuel supply is correspondingly be at its lowest supply rate. This low range setting is the turn-down setting of the turbo burner assembly 10 in which the burner opera'es at idle and produces its lowest energy output while still operating.

The complete closing of the air valve 35 allows essentially no air flow through the main spinner assembly. However, high pressure turbo air is supplied through the tap duct 50 and is introduced through the coupling 53 into the into the inner high pressure air tube 48. Because at the described idle setting of the burner assembly 10 there is only a minimum usage of turbo air. With the turbo compressor 24 operating at speed, the pressure of the turbo air, though comparatively constant over its entire expected flow rate, is nevertheless at its highest pressure. However, over the entire range of combustion settings for the burner assembly 10, the velocity and volume of the stream of air exiting past the spinner vanes 47 remains substantially constant. In reference to FIGS. 2 and 3, the high pressure of the turbo air is converted to kinetic energy and the turbo air exits from the tube 48 at comparatively high velocity and with force. The volume of the stream surrounding the atomizer assembly constitutes the low combustion air volume required for complete combustion at idle. The velocity and volume of the air generated by the high pressure air remains substantially constant over all power settings, the air exiting through a gap 89 between the atomizer assembly 41 and the inner wall of the tube 48. The spinner vanes 47 deflect the exiting high pressure turbo air into a conically outward directed flow pattern. The skewed deflected path of the turbo air intercepts the conical path of the dispersed liquid fuel to mix with the fuel and to further "atomize" or disperse the liquid fuel into a desired combustion mixture.

The conically outward directed flow pattern is known to cause a low if not reverse axial flow direction of combustion gases as indicated by arrows 90. The reverse flow turbulence slows the flame progression in the conically expanding flame holder cone 37 to cause the flame to remain substantially stationary under a full range of air flow conditions. As the fuel and air supply is increased, the gas flow will increase, but also the referred to reverse flow turbulence will increase due to the increased outward draft along the expanding wall of the flame holder cone 37.

As the fuel supply through the fuel supply line 39 is increased and the air valve 35 is gradually opened to correspond to the increased fuel flow, turbo air is admitted into the inlet portion of the turbo housing and advances into the flame region between the main spinner vanes 58 of the assembly 59. The turbo air having substantially more area to advance to the flame region is throttled by the air valve 35, advancing at a higher flow rate but at a lower pressure and hence ultimately lower velocity than the velocity of the high pressure turbo air exiting through the spinner vanes 47 adjacent the atomizer assembly 41. The high pressure turbo air continues to flow at the increased burner output setting to mix with the additional turbo air flow as described. At increased combustion settings the inner stream of the high pressure or high velocity turbo air provides further initial mixing and dispersion for the correspondingly increased flow of fuel. Though it provides for further dispersion of the fuel, the high pressure turbo air is insufficient to provide the proper combustion air to fuel mixture. The high velocity of the high pressure turbo air, however, quickly drives the dispersed and initially mixed fuel outward into contact with the low pressure turbo air entering through the spinner assembly 59 into the flame region. At intermediate settings, the low pressure turbo air may not have the velocity that is has at maximum burner capacity settings. At such intermediate settings the high pressure turbo air flow from the tube 48 drives the fuel into mixing contact with the existing low pressure turbo air flow.

The combustion sequence and process consequently comprises initial atomization or dispersion of liquid fuel with compressed air. The air is then mixed with primary combustion air consisting of high pressure turbo air supplied at a preferred pressure of 26 to 30 inches as described to produce an adequate air velocity and mixing within an inner conical air flow configuration. At low settings the inner conical air flow configuration provides substantially all of the required combustion air and no further turbo air is supplied. At higher energy output settings of the burner unit the initial mixture of the high velocity turbo air and the fuel mixes with the needed additional primary air exiting at lower velocity through the main spinner assembly 59. The conical flame holding configuration is supplied by the burner assembly 10 at low, high and intermediate settings as described herein.

The same process of fuel and combustion air mixing applies when a gaseous fuel is supplied through the annular space 54 within the tube 49. The high pressure turbo air gains high speed when exiting between the vanes 47 into the flame region 42 of the burner head. The outward skewed turbo air having gained high speed entrains the already gaseous fuel molecules and readily mixes therewith. At higher fuel flow rates, the high velocity of the turbo air forming the inner cone of combustion air drives the fuel toward and into the outer cone of combustion air exiting through the main spinner assembly 59. In all cases, whether with liquid fuel or gaseous fuel, at high air flow rates the outermost cone of air adjacent the conical surfaces of the burner head 31 entrains additional combustion air through the gap 70. This additional air is also referred to as secondary air.

It is to be understood that the invention has been described with respect to a particular embodiment and with respect to a particular environment. The described dual conical combustion air supplies into the flame region 42 adjacent the burner head 31 are found to provide mixing of fuel and combustion air not only at normally high energy output settings, but also at the low turn-down setting. The continued function of the high pressure turbo air to drive the stream of dispersed fuel toward and into contact with the low pressure turbo air entering through the main spinner assembly provides good fuel and air mixtures throughout the intermediate settings.

Figure 4:
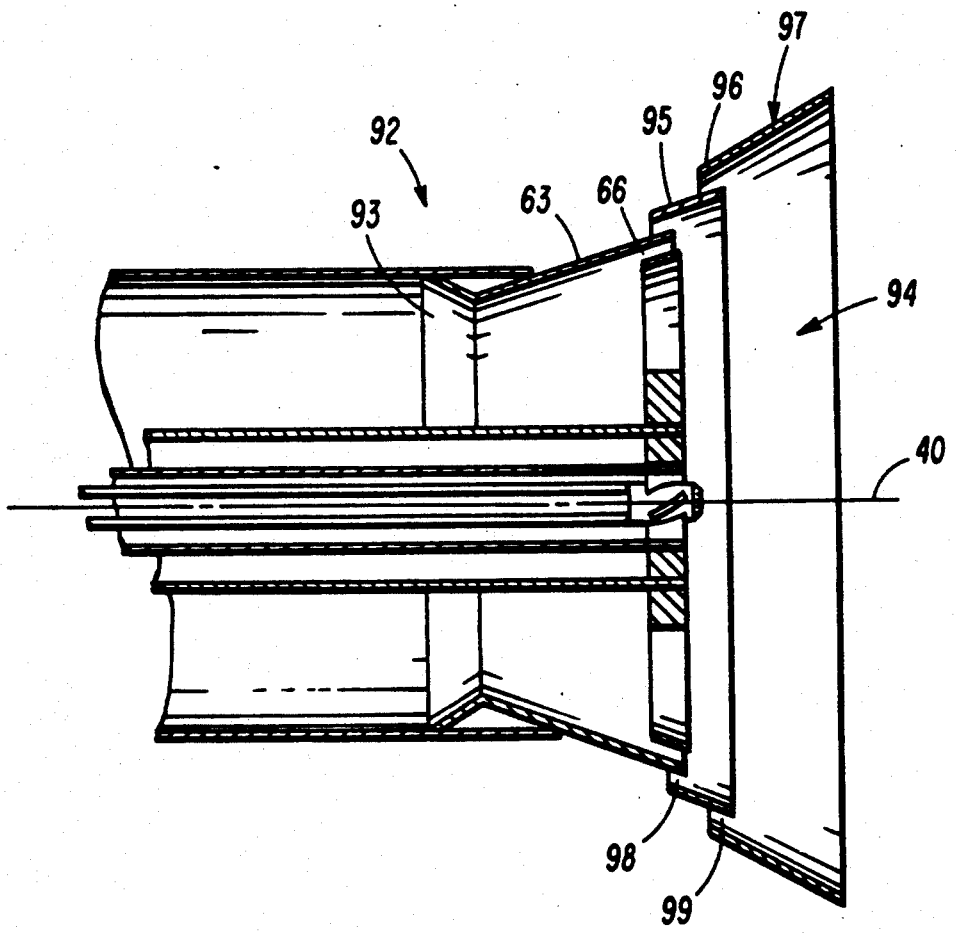
FIG. 4 is a simplified sectional view through a burner head showing modifications with respect to the burner head of FIG. 3, the modifications pertaining to improving air flow into a flame region adjacent the burner head.

In reference to FIG. 4 modifications may be seen which have been found to enhance the operation of a burner head designated generally by the numeral 92. It has been found that bringing the front shell portion 63 inward with respect to the cylindrical shell portion 62 and by inserting a leading filler cone 93 to provide for a smooth transition for the turbo air passing through the interior of the burner head 92, a venturi is created which enhances the subsequent radial flow of the turbo air outward away from the central axis 40. The radially outward flow of the air is used to enhance the air flow along the periphery of the conical burner head structure which forms a flame holder cone structure 94. As illustrated in FIG. 4, a typically single flame holder cone has been improved by dividing the typical cone into two parts. A first frustro-conical flame holder ring 95 fits over the end of the flaring shell portion 63. The flared end of the ring 95 in turn fits inside of a small end 96 of a second frustro-conical flame holder ring 97. Each ring provides an annular space between itself and the neighboring conical parts. Thus, as shown in FIG. 4, there are two annular gaps 98 and 99. The turbo air flowing through the gap 66, upon passing interiorly of the gaps 98 and 99 at high velocity past the gaps 98 and 99 induces air to flow into the gaps. It has been found that at high burner settings the turbo air is advantageously supplemented by the entrained secondary air and permits additional fuel to be injected for a higher energy output.

Various changes and modifications in the structure of the described embodiment are possible without departing from the spirit and scope of the invention as defined by the terms of the claims appended hereto and reasonable equivalents thereof.

What is claimed is:

1. A method of providing combustion gases over a range of combustion settings of a turbo burner assembly, comprising:

generating a supply of turbo air under a first pressure above atmospheric pressure;

dispersing a quantity of liquid fuel by means of compressed air above the first pressure of the turbo air;

introducing the quantity of dispersed fuel into a flame region adjacent the burner assembly and varying a rate of introduction of the fuel between a low setting and a high setting over the range of combustion settings;

introducing a first stream of primary combustion air from the supply of turbo air into the flame region in a conically expanding pattern, and entraining the dispersed fuel into the conically expanding first stream of primary combustion air;

introducing a second stream of primary combustion air from the supply of turbo air into the flame region and varying the rate separately from said first stream in accordance with variations in the rate of introduction of the fuel and mixing the first stream of primary combustion air and the entrained fuel with the second stream of combustion air, thereby providing a desirable combustion air to fuel mixture ratio over the range of combustion settings; and passing a portion of the second stream of primary combustion air through means forming an annular gap and means forming a further annular gap communicating with the ambient on entering the flame region, the portion of the second stream of primary combustion air drawing additional air from the ambient into the flame region.

2. A burner assembly operable over a range of combustion settings comprising:

a burner head, and a flame holder cone disposed adjacent the burner head;

means for dispersing a quantity of liquid fuel from the burner head into the flame holder cone;

means for generating a conically expanding first stream of combustion air at a first velocity and at a first flow rate from an annular region adjacent the fuel dispersing means, for entraining dispersed fuel within the first stream and thereby further dispersing the fuel within the first stream of combustion air, the first velocity of the first stream of combustion air remaining substantially constant over the range of combustion settings of the burner assembly;

a means for routing a second stream of combustion air to the flame holder cone;

a main spinner vane assembly for deflecting a main portion of the second stream of combustion air in a conically expanding pattern disposed annularly about the first stream of combustion air into the flame holder cone;

gap means between the main spinner vane assembly and an outer portion of the burner head for passing a remaining portion of the second stream of combustion air undeflected by the spinner vanes into the flame holder cone;

an annular opening disposed between the flame holder cone and the burner head, the annular opening being disposed adjacent the flow of the remaining undeflected portion of the second stream of combustion air, the undeflected portion drawing additional combustion air through the annular opening to the flame holder cone; and throttling means disposed within the routing means of the second stream of combustion air for varying the flow rate of the second stream of combustion air concurrent with a change in combustion setting.

3. The burner assembly according to claim 2, wherein the means for dispersing a quantity of liquid fuel comprises an atomizer assembly including atomizer nozzles and means for further supplying compressed air to force the liquid fuel through the atomizer assembly thereby dispersing the liquid fuel before the fuel becomes mixed with the first stream of combustion air and then with the second stream of combustion air.

4. The burner assembly according to claim 2, further including means for introducing a gaseous fuel in an annular flow pattern between the means for generating the first stream of combustion air and the main spinner vane assembly, whereby a gaseous fuel may be introduced into the flame holder come and mixed with the first and second streams of combustion air.

5. The burner assembly according to claim 2, wherein the means for generating a first stream of conically expanding combustion air comprises turbo compressor means for generating a supply of turbo air at a pressure above atmospheric pressure, means for tapping into the supply of turbo air and for routing the turbo air into an annular space about the means for dispersing a quantity of liquid fuel.

6. The burner assembly according to claim 5, wherein the means for generating a first stream of conically expanding combustion air comprises a spinner vane assembly disposed annularly about the means for dispersing a quantity of liquid fuel, the first stream of combustion air passing through the spinner vane assembly into the flame holder cone.

7. The burner assembly according to claim 2, wherein the burner head comprises a first cylindrical shell portion and a conically expanding portion disposed adjacent the flame holder cone and extending into the flame holder cone and forming with the flame holder cone the annular opening therebetween.

8. The burner assembly according to claim 2, wherein the burner head comprises a first cylindrical shell portion and a conically expanding portion disposed adjacent the flame holder cone, and an annular inward formed venturi portion disposed between the first cylindrical shell portion and the conically expanding portion and leading into the conically expanding portion.

9. The burner head assembly according to claim 8, wherein the conically expanding portion further includes a flared end ring, the flared ring forming a first annular opening adjacent the main spinner vane assembly and extending into the flame holder cone and forming a second annular opening with the flame holder cone for drawing additional combustion air through both the first and the second annular openings.

10. The burner assembly according to claim 2, wherein the means for generating a first stream of conically expanding combustion air comprises turbo compressor means for generating a supply of turbo air at a pressure above atmospheric pressure, means for tapping into the supply of turbo air and for routing the turbo air into an annular space about the means for dispersing a quantity of liquid fuel, and the means for routing a second stream of combustion air to the flame holder cone comprises an annular passage extending through the burner head externally of the first stream of combustion air.

* * * * *